US007944324B2

(12) United States Patent
Girard et al.

(10) Patent No.: US 7,944,324 B2
(45) Date of Patent: May 17, 2011

(54) COMPACT ORTHOMODE TRANSDUCTION DEVICE OPTIMIZED IN THE MESH PLANE, FOR AN ANTENNA

(75) Inventors: Thierry Girard, Toulouse (FR); Harry Chane-Kee-Sheung, Toulouse (FR); Pierre Bosshard, Tournefeuille (FR); Laurence Laval, Toulouse (FR)

(73) Assignee: Thales, Neuilly-sur-Seine (FR)

( * ) Notice: Subject to any disclaimer, the term of this patent is extended or adjusted under 35 U.S.C. 154(b) by 199 days.

(21) Appl. No.: 12/375,297

(22) PCT Filed: Jul. 27, 2007

(86) PCT No.: PCT/EP2007/057797

§ 371 (c)(1), (2), (4) Date: May 18, 2009

(87) PCT Pub. No.: WO2008/012369

PCT Pub. Date: Jan. 31, 2008

(65) Prior Publication Data

US 2009/0309674 A1 Dec. 17, 2009

(30) Foreign Application Priority Data

Jul. 28, 2006 (FR) ..... 06 53180

(51) Int. Cl.
*H01P 1/161* (2006.01)
*H01P 5/12* (2006.01)

(52) U.S. Cl. ..... 333/126; 333/137; 333/252

(58) Field of Classification Search ..... 333/21 R, 333/21 A, 137, 122, 135, 239, 248, 252, 125, 333/126

See application file for complete search history.

(56) References Cited

U.S. PATENT DOCUMENTS 3,670,268 A * 6/1972 Connerney ..... 333/122
5,442,329 A * 8/1995 Ghosh et al. ..... 333/21 R

* cited by examiner

FOREIGN PATENT DOCUMENTS

DE 3824150 A1 7/1989

OTHER PUBLICATIONS

Walter Steffe, "A novel compact OMJ for Ku Band Intelsat applications", Institute of Electrical and Electronics Engineers (IEEE) Antennas and Propagation Society International Symposium Digest, Jun. 18-23, 1995, pp. 152-155, vol. 1, held in conjunction with the USNC/URSI National Radio Science Meeting, IEEE Antennas and Proagation Society Isternational Symposium Digest, XP000586859.

*Primary Examiner* — Stephen E Jones
(74) *Attorney, Agent, or Firm* — Baker & Hostetler LLP

(57) ABSTRACT

An orthomode transducer device (D), for an antenna, comprises (i) a main guide (GP) designed for the propagation along a main axis of first and second modes having polarizations orthogonal to each other and provided with a first end coupled to a circular port (AC) and a second end, (ii) a first auxiliary guide (GA1) designed for the propagation of the first mode along a first auxiliary axis and provided with a first end coupled in series to the second end of the main guide via a series window (FSP) and with a second end coupled to a series port (AS), and (iii) a second auxiliary guide (GA2) designed for the propagation of the second mode along a second auxiliary axis, coupled to the main guide via a parallel window (FPL) and provided with a first end coupled to a parallel port (AP). The first (GA1) and second (GA2) auxiliary guides are superposed. The parallel window (FPL) is defined between an upper wall (PS) of the main guide (GP) and a lower wall (PI) of the second auxiliary guide (GA2) and oriented in relation to the main axis so as to enable coupling of the main guide to the second auxiliary guide for the selective transfer of the second mode from one to the other, and so as to make the first mode propagate between the main guide and the first auxiliary guide.

20 Claims, 3 Drawing Sheets

COMPACT ORTHOMODE TRANSDUCTION DEVICE OPTIMIZED IN THE MESH PLANE, FOR AN ANTENNA

CROSS REFERENCE TO RELATED APPLICATIONS

This is a national stage of International application PCT/EP2007/057797, filed Jul. 27, 2007, which claims priority of French application no. 0653180, filed Jul. 28, 2006, the disclosure of each application is incorporated herein by reference in its entirety.

BACKGROUND OF THE INVENTION

The invention relates to the field of transmitter and/or receiver antennas, optionally of the array type, and more particularly to orthomode transducer devices (or "transducers") which equip such antennas.

"Antenna" is here understood to mean both a single elementary radiation source coupled to an orthomode transducer device and an array antenna.

Furthermore, an "array antenna" is here understood to mean an antenna that is able to function in transmission and/or in reception and comprising an array of elementary radiation sources and control means suitable for controlling, by means of (an) active system(s), the amplitude and/or the phase of the radiofrequency signals to be transmitted (or in the reverse direction, received from space in the form of waves) by the elementary radiation sources according to a chosen diagram. Consequently, it can equally be a so-called direct radiation antenna (often designated by the English acronym DRA), one that is active or more rarely passive, or active or passive sources of the array type located in front of a reflector(s) system.

Moreover, "orthomode transducer" is here understood to mean what the person skilled in the art would know by the acronym OMT, that is to say a device designed to be connected to an elementary radiation source, such as a horn, so as selectively to feed it (in transmission) or be fed (in reception) either with a first electromagnetic mode having a first polarization or with a second electromagnetic mode having a second polarization orthogonal to the first. The first and second polarizations are generally linear (horizontal (H) and vertical (V)). However, circular polarization can also be produced by adding additional components with a view to creating the appropriate phase states.

Such a transducer comprises for example:

- a main (wave)guide designed for the propagation along a main (radioelectric) axis of first and second electromagnetic modes having first and second polarizations orthogonal to each other and provided with a first end (coupled to a circular port suited to the first and second modes and designed to be connected to an elementary radiation source) and a second end;
- a first auxiliary (wave)guide designed for the propagation of the first electromagnetic mode along a first auxiliary (radioelectric) axis. The first radioelectric axis is collinear with the radioelectric axis of the main guide but is not necessarily coincident with it. The first auxiliary guide is provided with a first end, coupled in series to the second end of the main guide via a series window, and with a second end coupled to a series port suited to the first mode; and
- at least one second auxiliary guide designed for the propagation of the second electromagnetic mode along a second auxiliary (radioelectric) axis, coupled to the main guide via at least one parallel window and provided with a first end coupled to a parallel port suited to the second mode.

As the person skilled in the art knows, in an array antenna the space available for inserting radiating elements (or elementary radiation sources) depends directly on the size of the mesh (or the basic pattern) of the array, which is fixed by the operational needs (frequency band intended, performance optimization, reduction of losses by lobes of the array (in the case of a DRA), sampling of the focal spot (in the case of a reflector antenna and an array-type source)).

In the bipolarization applications intended here, and in particular when the bipolarization is linear, it is necessary to locate the orthomode transducer (OMT) just behind the corresponding elementary radiation source. Yet when the OMTs are produced with waveguide technology, their size in the plane of the mesh (perpendicular to the main axis) quickly becomes greater than that of the mesh (typically greater than or equal to 1.2λ, where λ is the operating wavelength in a vacuum). Specifically, in the most commonly used OMTs at least one second auxiliary guide is connected to the main guide (or body of the OMT) by a bend, although their size in the plane of the mesh is typically around 3λ. In this case there is incompatibility between the size of the OMTs and that of the mesh.

In the document by W. Steffe "A novel compact OMJ for Ku band intelsat applications", IEEE Antennas and Propagation Society International Symposium, June 1995, AP-S. Digest, volume 1, it has been proposed to produce orthomode junctions (or OMJs) of reduced compactness. This type of OMJ comprises a main (wave)guide, of the aforementioned type, of square cross section and designed to be coupled via a series window to a first auxiliary guide in series (suited to the propagation of the first electromagnetic mode), and a second auxiliary guide of rectangular cross section suited to the propagation of the second electromagnetic mode, coupled to the main guide via a parallel window and provided with a first end designed to be coupled to a parallel port suited to the second mode. The parallel window is defined between a lateral wall of the main guide and a lateral wall of the second auxiliary guide (which extends over a height equal to that of the shorter side of its rectangular cross section), while the second auxiliary guide extends in the plane of the mesh over a distance equal to that of the longer side of its rectangular cross section. The OMJ therefore has a space requirement in the plane of the mesh typically of around 2λ, which still proves to be too high. In addition, the positioning of the ports then makes the architecture of the complete antenna much more complicated and has the effect of increasing the assessments of mass and size requirement.

No known solution is completely satisfactory; the invention therefore aims to improve the situation.

SUMMARY OF THE INVENTION

To this end, it proposes an orthomode transducer device for an antenna (optionally an array antenna) of the type of that presented at the start of the introductory part and in which:

- the first and second auxiliary guides are located one above the other so that their first and second (radioelectric) auxiliary axes are parallel to the main (radioelectric) axis of the main guide; and
- each parallel window is defined between an upper wall of the main guide and a lower wall of the second auxiliary guide, and oriented in relation to the main axis so as, on the one hand, to enable coupling of the main guide to the second auxiliary guide for the selective transfer of the second mode from one to the other and, on the other hand, so as to make the first mode propagate between the main guide and the first auxiliary guide.

In other words, the invention proposes placing the second auxiliary guide above the main guide (optionally with a slight lateral offset) and not alongside the latter, then defining each parallel window in a position that is parallel or transverse in relation to the main axis depending on whether the first and second auxiliary guides have the same orientation or orientations perpendicular to each other.

The device according to the invention may comprise other features that may be taken separately or in combination, and notably:

- its second auxiliary guide may, for example, comprise a second end opposite the first and closed so as to define a short-circuit;
- in a first embodiment it may comprise a parallel window of rectangular shape having a long side parallel to the main axis and a short side of length much less than this long side, and defined, on the one hand, approximately at the center of the upper wall of the main guide and, on the other hand, in an area of the lower wall of the second auxiliary guide which is laterally offset in relation to the second auxiliary axis. In this case, the first and second auxiliary guides and the series and parallel ports have transverse rectangular cross sections whose long sides are parallel to each other (which corresponds to a situation in which the first and second auxiliary guides have the same orientation);
  - the area of the lower wall of the second auxiliary guide is, for example, situated close to a lateral wall of this second auxiliary guide;
- in a second embodiment the main axis and the second auxiliary axis may be approximately superposed, one on the other. In this case, each parallel window has a rectangular shape with a long side perpendicular to the main axis and a short side of length much less than the long side, and is defined in a centered or decentered position in relation to the main axis and to the second auxiliary axis. Furthermore, the first auxiliary guide and the series port have rectangular cross sections the long sides of which are parallel to each other, and the second auxiliary guide and the parallel port have rectangular cross sections the long sides of which are parallel to each other and perpendicular to the long sides of the first auxiliary guide and of the series port (which corresponds to a situation in which the first and second auxiliary guides have different orientations);
  - it may comprise one, two, even three (or even more) parallel windows of rectangular shape, of size chosen to be identical or different with a view to modulating the fraction of energy coupled by each window and spaced a chosen distance apart.

The invention also proposes an antenna equipped with an orthomode transducer device of the type of that presented above and coupled to a single elementary radiation source.

The invention also proposes an array antenna equipped with a multiplicity of orthomode transducer devices of the type of that presented above and respectively coupled to elementary radiation sources arranged in an array having a chosen mesh, for example of the hexagonal type.

BRIEF DESCRIPTION OF THE DRAWINGS

Further features and advantages of the invention will become apparent on examination of the detailed description below and of the appended drawings, in which.

The appended drawings will be able not only to serve to complement the invention, but, if necessary, also to contribute to its definition.

DETAILED DESCRIPTION

The object of the invention is to enable the production of orthomode transducer devices with optimized compactness, preferably without a decoupling vane (or septum) for a transmission and/or reception antenna (optionally of the array type).

In the following it will be assumed, by way of nonlimiting example, that the antenna is a direct radiation array (or DRA) antenna and, for example, is active. It therefore comprises an array of elementary radiation sources, such as horns for example, each coupled to an orthomode transducer device D according to the invention, and control means suitable for controlling, by means of (an) active system(s), the amplitude and/or phase of the radiofrequency signals to be transmitted (or in the reverse direction, received from space in the form of waves) by the elementary radiation sources according to a chosen diagram. However, the invention is not limited to this type of antenna. It in fact relates, on the one hand, to any type of DRA or other array antenna, and notably to the array sources located in front of a reflector(s) system such as active or passive, reconfigurable or non-reconfigurable FAFR-type antennas for example, and, on the other hand, to a single elementary radiation source coupled to a device according to the invention.

For example, the array antenna is on board a multimedia telecommunications satellite in the Ka band (transmission at 18.2 GHz to 20.2 GHz or reception at 27.5 GHz to 30 GHz) or in the Ku band (transmission at 10.7 GHz to 12.75 GHz or reception at 13.75 GHz to 14.5 GHz). Nonetheless, the proposed device remains applicable to any other frequency band.

Furthermore, the two polarizations radiated may be in the same frequency band or in different frequency bands.

Reference will first of all be made to FIGS. 1 to 4 in order to describe a first exemplary embodiment of an orthomode transducer device D according to the invention.

Figure 1:
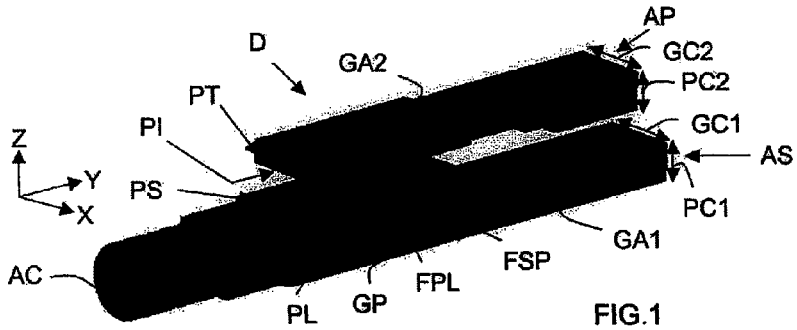
FIG. 1 illustrates very schematically, in a perspective view, a first exemplary embodiment of an orthomode transducer device according to the invention.
Figure 2:
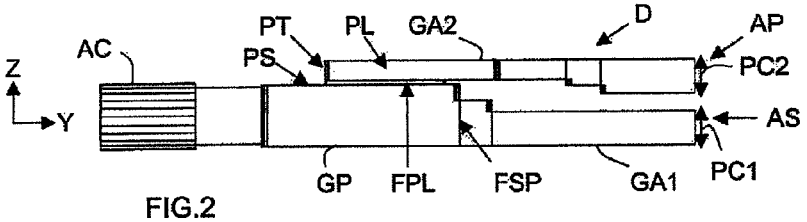
FIG. 2 illustrates very schematically, in a side view (YZ plane), the first exemplary embodiment of the orthomode transducer device illustrated in FIG. 1.
Figure 3:
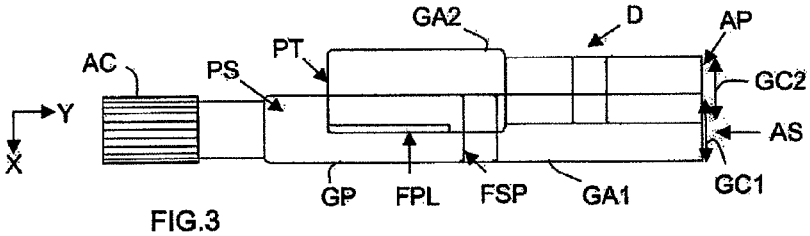
FIG. 3 illustrates very schematically, in a view from above (XY plane), the first exemplary embodiment of the orthomode transducer device illustrated in FIG. 1.
Figure 4:
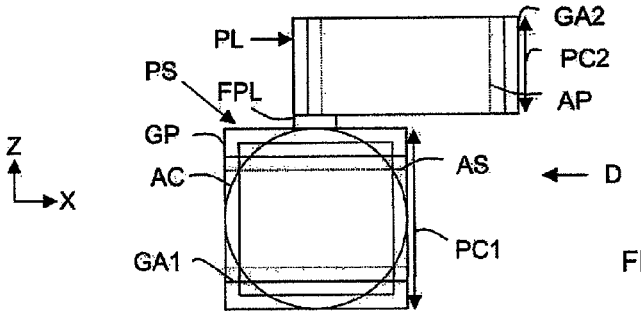
FIG. 4 illustrates very schematically, in a cross-sectional view through the XZ plane, the first exemplary embodiment of the orthomode transducer device illustrated in FIG. 1.
Figure 5:
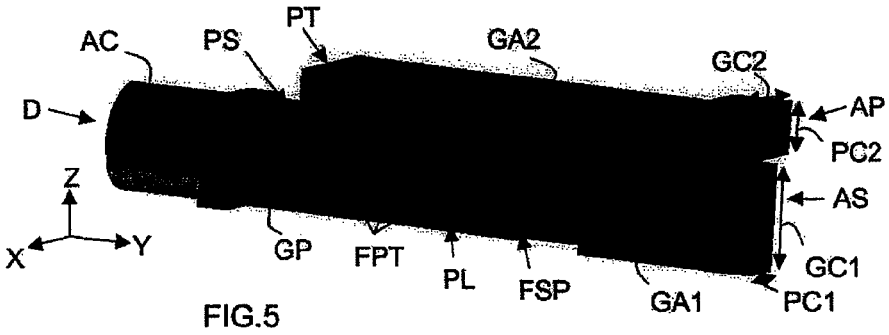
FIG. 5 illustrates very schematically, in a perspective view, a second exemplary embodiment of an orthomode transducer device according to the invention.
Figure 6:
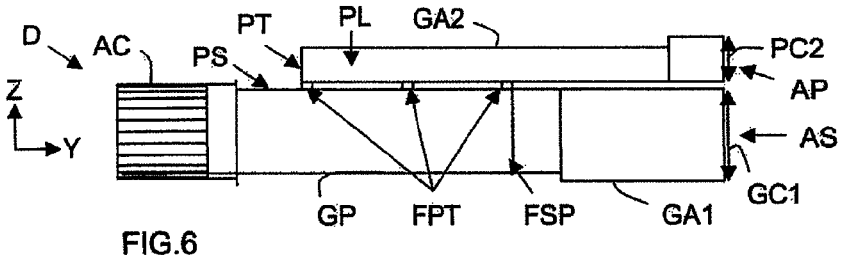
FIG. 6 illustrates very schematically, in a side view (YZ plane), the second exemplary embodiment of the orthomode transducer device illustrated in FIG. 5.
Figure 7:
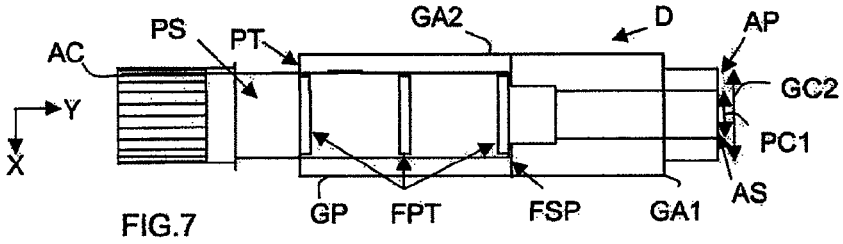
FIG. 7 illustrates very schematically, in a view from above (XY plane), the second exemplary embodiment of the orthomode transducer device illustrated in FIG. 5.
Figure 8:
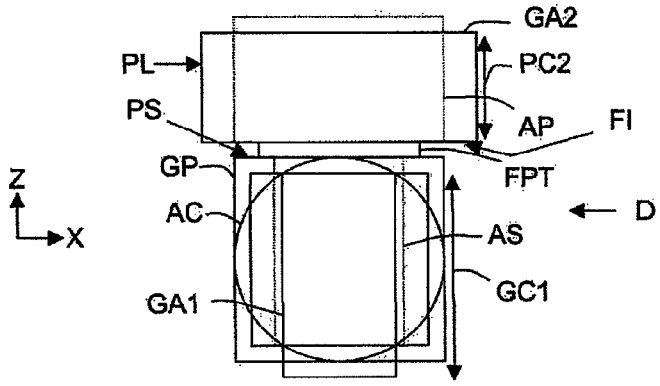
FIG. 8 illustrates very schematically, in a cross-sectional view through the XZ plane, the second exemplary embodiment of the orthomode transducer device illustrated in FIG. 5.

As is schematically illustrated in FIG. 1, an orthomode transducer device D according to the invention comprises at least one main waveguide (or main body) GP coupled to a circular port AC, a first auxiliary waveguide GA1 coupled in series to the main (wave)guide GP and to a series port AS (marked in FIG. 4), and a second auxiliary waveguide GA2 coupled in parallel to the main guide GP and to a parallel port AP (marked in FIG. 4).

The main guide GP is a parallelepiped the cross section of which (in the XZ plane) is for example rectangular or square in shape. However, it is also possible that the main guide GP is circular in shape, although this solution is not that currently preferred. It extends in a longitudinal direction (Y) which also defines the main radioelectric axis of the device D. Its dimensions are chosen so as to allow propagation along the main (radioelectric) axis Y of radiofrequency (RF) signals according to first and second electromagnetic modes, respectively having first P1 and second P2 polarizations that are orthogonal to each other.

For example, the first and second electromagnetic modes are TE10 (dominant mode) and TE01 respectively.

For example, the first P1 and second P2 polarizations are of the linear type, P1 being for example vertical (V) and P2 horizontal (H), or vice versa. It will be observed, however, that the invention also allows the production of circular polarizations by adding suitable components with a view to obtaining the necessary electrical phase conditions (for example, by adding hybrid couplers to the two rectangular guide ports, or else a polarizer on the main circular guide).

The main guide GP comprises two "lateral" walls PL (in the YZ plane), a "lower" wall (in the XY plane) and an "upper" wall PS (in the XY plane). The concepts "lateral", "lower" and "upper" should here be understood in reference to the figures, an upper wall PS of a guide consequently being located above a lower wall of this same guide and perpendicular to the two lateral walls PL of said guide. Of course, these concepts are used only to facilitate the description and do not concern the final orientation of the walls of a main guide GP or auxiliary guide GA1 or GA2 once the device D is integrated in an antenna (here of the array type by way of example).

These lateral PL, lower and upper PS walls internally delimit a main cavity provided with first and second ends. The first end is coupled to the circular port AC which is suited to the first and second modes (having the first P1 and second P2 polarizations respectively) and which is designed to be connected to an elementary radiation source. A window called a "series" window FSP is defined at the second end. It is preferably quite rectangular in shape, its long side being, for example, parallel to the Z axis.

The upper wall PS of the main guide GP comprises at least one aperture of a chosen shape constituting a part of a window called a "parallel" window FPL or FPT.

The first auxiliary (wave)guide GA1 is, for example, generally parallelepipedal in shape with a cross section (in the XZ plane) of rectangular shape (though other shapes may be conceived of, and notably circular or elliptical shapes). It extends in a longitudinal direction (Y) which also defines its (first) auxiliary radioelectric axis. It therefore extends, so to speak, the main guide GP along the Y axis. Its dimensions are chosen so as to enable the propagation along the first auxiliary (radioelectric) axis of radiofrequency (RF) signals according to the first electromagnetic mode having the first polarization P1.

The first auxiliary guide GA1 comprises two "lateral" walls (in the YZ plane), a "lower" wall (in the XY plane), and an "upper" wall (in the XY plane). These lateral, lower and upper walls internally delimit a first auxiliary cavity provided with first and second ends. The first end is coupled in series to the second end of the main guide GP via the series window FSP. The second end is coupled to the series port AS which is suited to the first mode having the first polarization P1 and is defined in the XZ plane.

For example, the series port AS has a rectangular shape. In the first exemplary embodiment, illustrated in FIGS. 1 to 4, the series port AS has a long side GC1 parallel to the X axis and a short side PC1 parallel to the Z axis.

It should be noted that the first auxiliary guide GA1 may not be a pure parallelepiped. It may, as illustrated, partly consist of at least two parts of parallelepipedal shape of chosen sections (in the plane perpendicular to the Y direction) and lengths (in the Y direction) so as to produce a change in the transverse dimensions of the guide (step transformer for impedance matching) with a view to optimizing electrical performance.

The second auxiliary (wave)guide GA2 is, for example, generally parallelepipedal in shape with a cross section (in the XZ plane) of rectangular shape. It extends in a longitudinal direction (Y) which also defines its (second) auxiliary radioelectric axis. Its dimensions are chosen so as to allow propagation along the second auxiliary (radioelectric) axis of radiofrequency (RF) signals according to the second electromagnetic mode having the second polarization P2.

The second auxiliary guide GA2 comprises two "lateral" walls (in the YZ plane), a "lower" wall PI (in the XY plane), and an "upper" wall (in the XY plane). These lateral, lower PI and upper walls internally delimit a second auxiliary cavity provided with first and second ends. The first end is coupled to the parallel port AP which is suited to the second mode having the second polarization P2 and is defined in the XZ plane. The second end is preferably terminated by an end wall PT (in the XZ plane) so as to define an electrical short-circuit in the second auxiliary cavity.

The lower wall PI of the second auxiliary guide GA2 comprises at least one aperture of the same chosen shape as that defined in the upper wall PS of the main guide GP and constituting a complementary part of a parallel window FPL or FPT.

For example, the parallel port AP is rectangular in shape. In the first exemplary embodiment illustrated in FIGS. 1 to 4, the parallel port AP has a long side GC2 parallel to the X axis and a short side PC2 parallel to the Z axis.

In a manner similar to the first auxiliary guide GA1, it should be noted that the second auxiliary guide GA2 may not be a pure parallelepiped. It may, as illustrated, consist of at least two parts of parallelepipedal shape but having different sizes (sections in the plane perpendicular to the Y direction, and lengths in the Y direction) so as to produce a step transformer with the aim of optimizing electrical performance.

In a manner also similar to the first auxiliary guide GA1, it should be noted that the main guide GP may not be a pure parallelepiped. It may consist of at least two different parts, one parallelepipedal in shape and the other circular cylindrical in shape, for impedance matching.

The first GA1 and second GA2 auxiliary guides are located one above the other so that their first and second auxiliary radioelectric axes are parallel to the main radioelectric axis of the main guide GP. The second auxiliary guide GA2 is therefore also located at least partly above the upper wall PS of the main guide GP.

It is important to note that the main guide GP (and its circular port AC) and the first GA1 and second GA2 auxiliary guides (and their series AS and parallel AP ports) may be made of two or three parts put together. However, it is also possible that they constitute a single-piece whole depending on the manufacturing method used. In this case, it is clear that the upper walls of the main guide GP and of the first auxiliary guide GA1 coincide with the lower wall PI of the second auxiliary guide GA2, although they contribute to defining a part of the main and auxiliary cavities.

As previously indicated, each parallel window FPL or FPT is defined between the upper wall PS of the main guide GP and the lower wall PI of the second auxiliary guide GA2. For example, when the upper wall PS of the main guide GP and the lower wall PI of the second auxiliary guide GA2 are placed up against each other or are coincident, a parallel window FPL or FPT can be constituted only by the two apertures that correspond to each other in the upper wall PS of the main guide GP and in the lower wall PI of the second auxiliary guide GA2. However, a parallel window FPL or FPT may also be constituted by two apertures that correspond to each other and by a connecting element providing the guiding function between these two apertures (this solution is not currently the preferred one due to attempts to limit the thickness (or length) of the connecting element as much as possible).

Each parallel window FPL or FPT is oriented in a chosen manner relative to the main radiofrequency axis for two reasons. The orientation must first of all allow the coupling of the main cavity (defined by the main guide GP) with the second auxiliary cavity (defined by the second auxiliary guide GA2) such that the second mode (having the second polarization P2) is selectively transferred either from the main guide GP to the second auxiliary guide GA2 when receiving (Rx), or from the second auxiliary guide GA2 to the main guide GP when transmitting (Tx). Moreover, the orientation must force the first mode (having the first polarization P1) to propagate either from the main guide GP to the first auxiliary guide GA1 when receiving (Rx), or from the first auxiliary guide GA1 to the main guide GP when transmitting (Tx).

The coupling of the second mode is imposed either by the length of the parallel window FPL and by its lateral offset (in the X direction) relative to the second auxiliary radiofrequency axis of the second auxiliary guide GA2, in the case of a longitudinal rectangular window the long side of which is parallel to the Y direction, or by the length(s) and/or the number of parallel windows FPT and/or the distance between windows and/or the position of the center of each parallel window FPT in relation to the second auxiliary RF axis in the case of a transverse rectangular window the long side of which is parallel to the X direction.

It should be noted that the distance between the short-circuit, located on the end wall PT of the second auxiliary guide GA2, and the nearest window FPL or FPT may also form part of the adjustment parameters.

The use of several parallel windows FPT allows distribution of the power between the latter.

Furthermore, the narrowness of each parallel window FLP or FPT enables the excitation of the first polarization P1 to be minimized, or in other words the level of rejection of the first polarization P1 to be fixed. This allows the use of decoupling vanes (or a septum) to be avoided, although that would also be possible here. For example, a width of between around $\lambda/10$ and $\lambda/20$ is chosen, where $\lambda$ is the operating wavelength of the device D.

The position of each parallel window FPL or FPT is chosen so as to optimize the coupling with the lines of current that correspond to the second mode and which are produced on the upper wall PS of the main guide GP and on the lower wall PI of the second auxiliary guide GA2.

Furthermore, the orientation of each parallel window FPL or FPT depends on the compactness sought for the device D in the X direction. Two classes of embodiment can be conceived of.

The first class brings together the embodiments in which each parallel window FPL is "longitudinally" rectangular (long side (or length) parallel to the Y direction) and located above and parallel to the main axis of the main guide GP and at the same time laterally offset (in the X direction) in relation to the second auxiliary radiofrequency axis of the second auxiliary guide GA2.

The second class brings together the embodiments in which each parallel window FPL is "transversely" rectangular (long side (or length) parallel to the X direction) and centered (but may also be offset (or decentered)) in relation to the main axis of the main guide GP and to the second auxiliary axis of the second auxiliary guide GA2 (the main axis and the second auxiliary axis then being located one above the other). "Centered position" is here understood to mean having the same transverse extension on both sides of the second auxiliary axis. The positioning of the parallel windows FPT in relation to the second auxiliary RF axis allows at least partial definition of the power that they transmit.

The first class corresponds to the first embodiment that is illustrated in FIGS. 1 to 4. In this example a single parallel window FPL rectangular and longitudinal in shape is shown, but it is possible to conceive of using several (at least two) of them, placed one after another and having the same orientation along the Y axis. In this case the lengths of the windows are not necessarily identical.

The greater the lateral (or transverse) offset of the longitudinal window FPL in relation to the second auxiliary axis, the more effective is the coupling of the lines of current of the second mode. In the example illustrated (see FIG. 4) the longitudinal window FPL opens into an area of the lower wall PI of the second auxiliary guide GA2 which is situated close to the lateral wall of the latter. The coupling is therefore optimal. However, it should be noted that the greater the lateral offset of the longitudinal window FPL in relation to the second auxiliary axis, the greater the lateral offset of the second auxiliary guide GA2 is in relation to the main guide GP and to the first auxiliary guide GA1. This lateral offsetting of the second auxiliary guide GA2 is equal to half its width (long side) GC2 at most. Consequently, the transverse (in the X direction) space requirement of the device D is equal to the sum of the width GC1 of the main guide GP and of half the width GC2 of the second auxiliary guide GA2, or GC1+GC2/2, at most.

In this first exemplary embodiment, due to the "longitudinal" orientation of the parallel window FPL, the first GA1 and second GA2 auxiliary guides and the series AS and parallel AP ports have rectangular cross sections the long sides of which are all parallel in the X direction. Consequently, the first GA1 and second GA2 auxiliary guides and the series AS and parallel AP ports all have the same "transverse" orientation (long sides GC1, GC2 in the X direction).

The second class corresponds to the second exemplary embodiment that is illustrated in FIGS. 5 to 8. By way of nonlimiting example, three parallel windows FPT of identical rectangular and transverse shape are shown, but it is possible to conceive of using a single one of them, or two, or even more than three in parallel.

The larger the number of transverse windows FPT and the greater the length (in the X direction) of each transverse window FPT, the more effective the coupling of lines of current of the second mode will tend to be. In the example illustrated (see FIGS. 5 to 7), the three transverse windows FPT are of the same length and each pair is equidistant. However, this is not necessary (the distance between windows can in fact vary). It should be noted that the lengths of the windows may also be adjustment parameters.

As the second auxiliary axis is here exactly superposed on the main axis and on the first auxiliary axis, the second auxiliary guide GA2 is therefore completely or almost completely located above the main guide GP and the first auxiliary guide GA1. Consequently, the transverse space requirement (in the X direction) of the device D is equal to that of the auxiliary or main guide that has the largest transverse extension. At least the transverse space requirement of the device D is therefore lowest for the second class of embodiment.

In this second exemplary embodiment, due to the "transverse" orientation of each parallel window FPT, the first auxiliary guide GA1 and its series port AS have rectangular cross sections the long sides GC1 of which are parallel to the Z direction, while the second auxiliary guide GA2 and its parallel port AP have rectangular cross sections the long sides GC2 of which are parallel to the X direction. The first GA1 and second GA2 auxiliary guides therefore have different orientations, as do the series AS and parallel AP ports.

Figure 9:
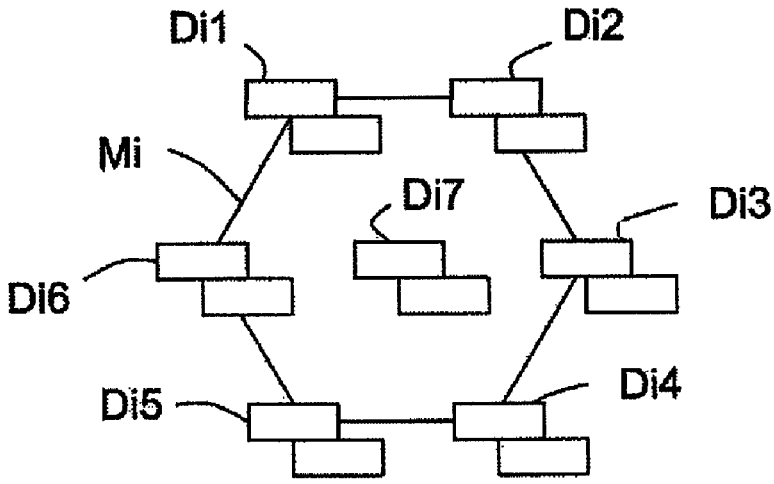
FIG. 9 illustrates very schematically an arrangement of orthomode transducer devices of the type of that illustrated in FIGS. 1 to 4 at the nodes of a mesh (here hexagonal, by way of example) of an array antenna array.

FIG. 9 schematically shows seven orthomode transducer devices Di1 to Di7 belonging to the first class and positioned at the nodes of an example of a hexagonal mesh (or elementary pattern) Mi of an array antenna array.

Figure 10:
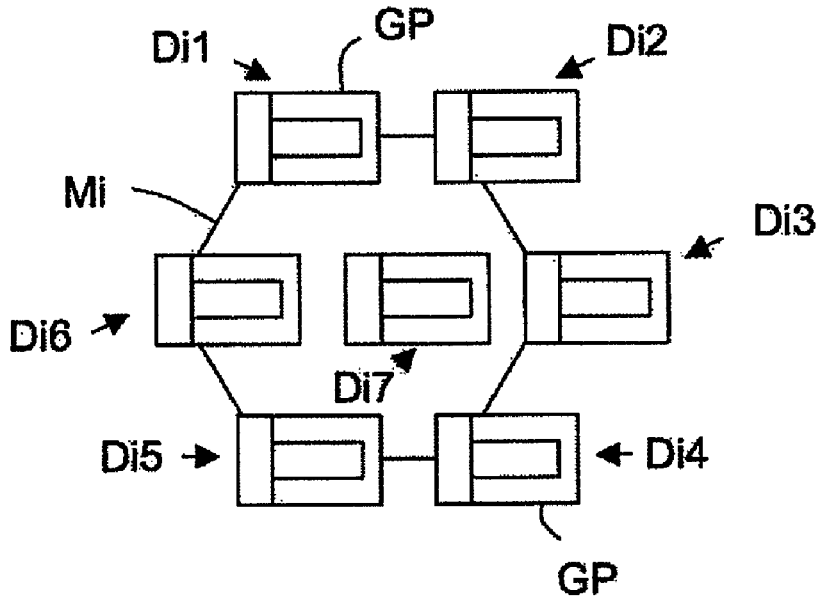
FIG. 10 illustrates very schematically an arrangement of orthomode transducer devices of the type of that illustrated in FIGS. 5 to 8 at the nodes of a mesh (here hexagonal, by way of example) of an array antenna array.

Similarly, FIG. 10 schematically shows seven orthomode transducer devices Di1 to Di7 belonging to the second class and positioned at the nodes of an example of a hexagonal mesh (or elementary pattern) Mi of an array antenna array.

Of course, the orthomode transducer devices D according to the invention may be differently arranged in relation so as to constitute other types of mesh (or elementary pattern) Mi of an array antenna array, for example triangular, rectangular, or whatever (i.e. a pattern that is not necessarily periodic).

Furthermore, in the preceding an example device D has been described in which the main guide GP is coupled in series to a series auxiliary guide GA1 and coupled in parallel to a parallel auxiliary guide GA2. However, the main guide GP may be coupled in series to a series auxiliary guide GA1 and coupled in parallel to one, two, three or four parallel auxiliary guides GA2. In the latter case the parallel auxiliary guides GA2 are coupled to the main guide GP at its various lateral walls (parallel to the XY and YZ planes). This can enable the device D to operate in a number of frequency bands between 1 and 5. It should be noted that these various parallel auxiliary guides GA2 do not necessarily have all their windows lying on the same side along the Y axis. Moreover, the cross section of the cavity of the main guide GP may also vary along the Y axis so as to take account of the various positions of said windows.

It should be noted that the device according to the invention can also be used when the space requirement constraint is not the major constraint, as is the case, for example, with single or isolated sources requiring single-frequency or dual-frequency bipolarization.

The invention is not limited to the embodiments of the orthomode transducer device and of the antenna (optionally of the array type) described above solely by way of example, but includes all the variants that a person skilled in the art might envision within the scope of the claims below.

The invention claimed is:

1. An orthomode transducer device (D) for an antenna, comprising (i) a main guide (GP) designed for the propagation along a main axis of first and second electromagnetic modes having first and second polarizations orthogonal to each other and provided with a first end coupled to a circular port (AC) suited to said first and second modes and a second end, (ii) a first auxiliary guide (GA1) designed for the propagation of said first electromagnetic mode along a first auxiliary axis, and provided with a first end coupled in series to said second end of the main guide (GP) via a series window (FSP) and with a second end coupled to a series port (AS) suited to said first mode, and (iii) a second auxiliary guide (GA2) designed for the propagation of said second electromagnetic mode along a second auxiliary axis, coupled to said main guide (GP) via at least one parallel window (FPL, FPT) and provided with a first end coupled to a parallel port (AP) suited to said second mode, wherein said first (GA1) and second (GA2) auxiliary guides are located one above the other so that their first and second auxiliary axes are parallel to said main axis, and each parallel window (FPL, FPT) is defined between an upper wall (PS) of the main guide (GP) and a lower wall (PI) of the second auxiliary guide (GA2), and oriented in relation to said main axis so as to enable coupling of the main guide (GP) to the second auxiliary guide (GA2) for the selective transfer of the second mode from one to the other and so as to make said first mode propagate between the main guide (GP) and the first auxiliary guide (GA1).

2. An antenna, further comprising a single orthomode transducer device (D) as in claim 1 and coupled to a single elementary radiation source.

3. The device as claimed in claim 1, further comprising at least one parallel window (FPL) of rectangular shape having a long side parallel to said main axis and a short side of length much less than said long side, and defined, on the one hand, approximately at the center of the upper wall (PS) of the main guide (GP) and, on the other hand, in an area of said lower wall (PI) of the second auxiliary guide (GA2) which is laterally offset in relation to said second auxiliary axis, and in that said first (GA1) and second (GA2) auxiliary guides and said series (AS) and parallel (AP) ports have transverse rectangular cross sections whose long sides are parallel to each other.

4. The device as claimed in claim 3, wherein said area of the lower wall (PI) of the second auxiliary guide (GA2) is situated close to a lateral wall of said second auxiliary guide (GA2).

5. The device as claimed in claim 1, wherein said main axis and second auxiliary axis are approximately superposed, one on the other, and further comprising at least one parallel window (FPT) having a rectangular shape with a long side perpendicular to said main axis and a short side of length much less than the long side, and defined in a centered position in relation to said main axis and second auxiliary axis, wherein said first auxiliary guide (GA1) and said series port (AS) have rectangular cross sections the long sides of which are parallel to each other, and said second auxiliary guide (GA2) and said parallel port (AP) have rectangular cross sections the long sides of which are parallel to each other and perpendicular to the long sides of the first auxiliary guide (GA1) and of the series port (AS).

6. The device as claimed in claim 5, further comprising at least one parallel window (FPT) of rectangular shape, of chosen size, and spaced a chosen distance apart.

7. The device as claimed in claim 1, wherein said main axis and second auxiliary axis are approximately superposed, one on the other, further comprising at least one parallel window (FPT) having a rectangular shape with a long side perpendicular to said main axis and a short side of length much less than the long side, and defined in a decentered position in relation to said main axis and second auxiliary axis, and wherein said first auxiliary guide (GA1) and said series port (AS) have rectangular cross sections the long sides of which are parallel to each other, and said second auxiliary guide (GA2) and said parallel port (AP) have rectangular cross sections the long sides of which are parallel to each other and perpendicular to the long sides of the first auxiliary guide (GA1) and of the series port (AS).

8. The device as claimed in claim 7, further comprising at least one parallel window (FPT) of rectangular shape, of chosen size, and spaced a chosen distance apart.

9. An array antenna, further comprising a multiplicity of orthomode transducer devices (D) as in claim 1 and respectively coupled to elementary radiation sources arranged in an array having a chosen mesh.

10. The array antenna as claimed in claim 9, wherein said mesh is of the hexagonal type.

11. The device as claimed in claim 1, wherein said second auxiliary guide (GA2) comprises a second end opposite the first and closed so as to define a short-circuit.

12. An antenna, further comprising a single orthomode transducer device (D) as in claim 11 and coupled to a single elementary radiation source.

13. The device as in claim 11, further comprising at least one parallel window (FPL) of rectangular shape having a long side parallel to said main axis and a short side of length much less than said long side, and defined, on the one hand, approximately at the center of the upper wall (PS) of the main guide (GP) and, on the other hand, in an area of said lower wall (PI) of the second auxiliary guide (GA2) which is laterally offset in relation to said second auxiliary axis, and in that said first (GA1) and second (GA2) auxiliary guides and said series (AS) and parallel (AP) ports have transverse rectangular cross sections whose long sides are parallel to each other.

14. The device as in claim 13, wherein said area of the lower wall (PI) of the second auxiliary guide (GA2) is situated close to a lateral wall of said second auxiliary guide (GA2).

15. The device as claimed in claim 11, wherein said main axis and second auxiliary axis are approximately superposed, one on the other, and further comprising at least one parallel window (FPT) having a rectangular shape with a long side perpendicular to said main axis and a short side of length much less than the long side, and defined in a centered position in relation to said main axis and second auxiliary axis, wherein said first auxiliary guide (GA1) and said series port (AS) have rectangular cross sections the long sides of which are parallel to each other, and said second auxiliary guide (GA2) and said parallel port (AP) have rectangular cross sections the long sides of which are parallel to each other and perpendicular to the long sides of the first auxiliary guide (GA1) and of the series port (AS).

16. The device as claimed in claim 15, further comprising at least one parallel window (FPT) of rectangular shape, of chosen size, and spaced a chosen distance apart.

17. The device as claimed in claim 11, wherein said main axis and second auxiliary axis are approximately superposed, one on the other, further comprising at least one parallel window (FPT) having a rectangular shape with a long side perpendicular to said main axis and a short side of length much less than the long side, and defined in a decentered position in relation to said main axis and second auxiliary axis, and wherein said first auxiliary guide (GA1) and said series port (AS) have rectangular cross sections the long sides of which are parallel to each other, and said second auxiliary guide (GA2) and said parallel port (AP) have rectangular cross sections the long sides of which are parallel to each other and perpendicular to the long sides of the first auxiliary guide (GA1) and of the series port (AS).

18. The device as claimed in claim 17, further comprising at least one parallel window (FPT) of rectangular shape, of chosen size, and spaced a chosen distance apart.

19. An array antenna, further comprising a multiplicity of orthomode transducer devices (D) as in claim 11 and respectively coupled to elementary radiation sources arranged in an array having a chosen mesh.

20. The array antenna as claimed in claim 19, wherein said mesh is of the hexagonal type.

* * * * *